US005526752A

United States Patent [19]

Dahl et al.

[11] Patent Number: 5,526,752

[45] Date of Patent: Jun. 18, 1996

[54] WEAPON FOR DESTRUCTION OF DEEPLY BURIED AND HARDENED TARGETS

[75] Inventors: Glenn E. Dahl, Torrance; Stephen G. Wurst, Lancaster, both of Calif.

[73] Assignee: Rockwell International Corporation, Seal Beach, Calif.

[21] Appl. No.: 300,888

[22] Filed: Sep. 6, 1994

[51] Int. Cl.[6] ..... F42B 12/00

[52] U.S. Cl. ..... 102/517; 102/307; 428/911

[58] Field of Search ..... 102/517, 309; 428/911

[56] References Cited

U.S. PATENT DOCUMENTS

| | | | |
|---|---|---|---|
| 4,524,697 | 6/1985 | Bocker et al. | 102/517 |
| 4,648,324 | 3/1987 | McDermott | 102/518 |
| 4,901,645 | 2/1990 | Bisping et al. | 102/521 |
| 4,967,666 | 11/1990 | Kellner et al. | 102/476 |
| 5,088,416 | 2/1992 | Sabranski | 102/517 |
| 5,097,766 | 3/1992 | Campoli et al. | 102/364 |

*Primary Examiner*—Peter A. Nelson

*Attorney, Agent, or Firm*—Charles T. Silberberg; Lawrence N. Ginsberg

[57] ABSTRACT

A projectile which includes multiple warheads separated one from another within a casing, each warhead having its own independent detonator. The warheads are arranged in spaced relationship along the longitudinal axis of the casing, and the detonators are linked with a fuzing mechanism located at the forward region of the casing. Upon reaching the target, the rearmost warhead in the projectile is detonated and the remaining warheads are then detonated sequentially forwardly, ad seriatim, by the fuzing mechanism.

10 Claims, 2 Drawing Sheets

WEAPON FOR DESTRUCTION OF DEEPLY BURIED AND HARDENED TARGETS

BACKGROUND OF THE INVENTION

1. Field of the Invention

The present invention relates to weapons for destroying deeply buried and hardened targets, and more particularly to plural, tandem warheads sequentially detonated upon reaching the target to increase probability of target destruction.

2. Description of the Related Art

Weapons serve various functions during the defense or attack of a territory. One such objective is the destruction of command and control centers. An increasing number of these potential targets are being buried deep underground and hardened with reinforced concrete overburdens. Until recently, the only capability against such deeply buried and hardened targets has been nuclear warheads. It has now been recognized that such weapons are an unacceptable solution for regional conflicts, and therefore efforts have been pursued to develop penetrating weapons with conventional warheads.

Such efforts have led to a new understanding of penetration physics, including terradynamic stability, as well as novel structural designs to preserve the integrity of the warheads and the fuze mechanism have evolved. U.S. Pat. No. 4,878,432 to Mikhail discloses a novel kinetic energy projectile for penetrating armor. The Mikhail projectile includes multiple, longitudinally stacked, penetrator stages that separate and fly independently of one another during flight, in a rearward to forward sequence. U.S. Pat. No. 4,090,446 to Tomasetti discloses a controlled depth-of-burial penetrator having a front section which, after a predetermined time following impact, separates from the rearward section and scoots off in a direction of about 45 degrees to the direction of motion of the rearward section.

Current work on penetrating weapons capable of destroying buried, hardened targets has focused on increasing penetration depth (see U.S. Statutory Invention Registration No. H867) and developing novel fuze systems to eliminate inaccuracies (see U.S. Pat. No. 4,606,272 to Kerdraon and U.S. Pat. No. 4,878,432 to Mikhail).

Fuzing problems stem from uncertainties relating to the nature of target overburdens. For time delay fuzes, uncertainty of soil composition and the thickness of concrete overburdens can lead to detonations at distances from the target that render the warhead ineffective. More sophisticated fuzes are being developed for measuring accelerations and other phenomena to correct for these uncertainties.

However, target uncertainty also arises due to lack of knowledge of the number of layers of structure to be penetrated, or the material of which the target is constructed, or the soil composition, or the number and frequency of voids. In these circumstances, detonations initiated by even sophisticated fuzes can occur at large distances from the target, thereby rendering the warhead ineffective.

Additionally, counter measures, such as rubble, can be employed in the overburden with introduce randomness to penetrating behavior, further complicating the ability of a sophisticated fuze to detonate in the target.

OBJECTS AND SUMMARY OF THE INVENTION

It is, therefore, a principal object of the present invention to provide a novel projectile-type weapon having multiple warheads within a single casing, with a fuzing arrangement which permits detonation of rearward, then sequentially forward, warheads upon the weapon's reaching the target.

Another object of the present invention is to provide a projectile having multiple warheads which are detonated sequentially, beginning with the aftmost warhead and moving forward toward the penetrating portion of the projectile.

Still another object of the invention is the provision of a weapon having multiple warheads, in which the rearmost warhead is initially detonated and the remaining warheads are detonated sequentially forwardly by a fuzing arrangement which includes a detonator located in the nose portion of the weapon.

Yet another object of the invention is to provide a projectile casing in which separate warheads are arranged in spaced relationship along the longitudinal axis of the weapon, and the warheads are detonated sequentially by a forwardly located fuzing mechanism.

These and other objects are achieved by the weapon of the present invention which includes multiple warheads separated one from another within a weapon casing, each warhead being provided with its own independent detonator. The warheads are arranged in spaced relationship along the longitudinal axis of the weapon casing, and the detonators are linked together to a fuzing mechanism located at the forward region of the weapon casing. Upon the weapon reaching the target, the rearmost warhead is initially detonated and the remaining warheads are then detonated sequentially forwardly by the fuzing mechanism.

DETAILED DESCRIPTION OF THE PREFERRED EMBODIMENTS

Figure 1:
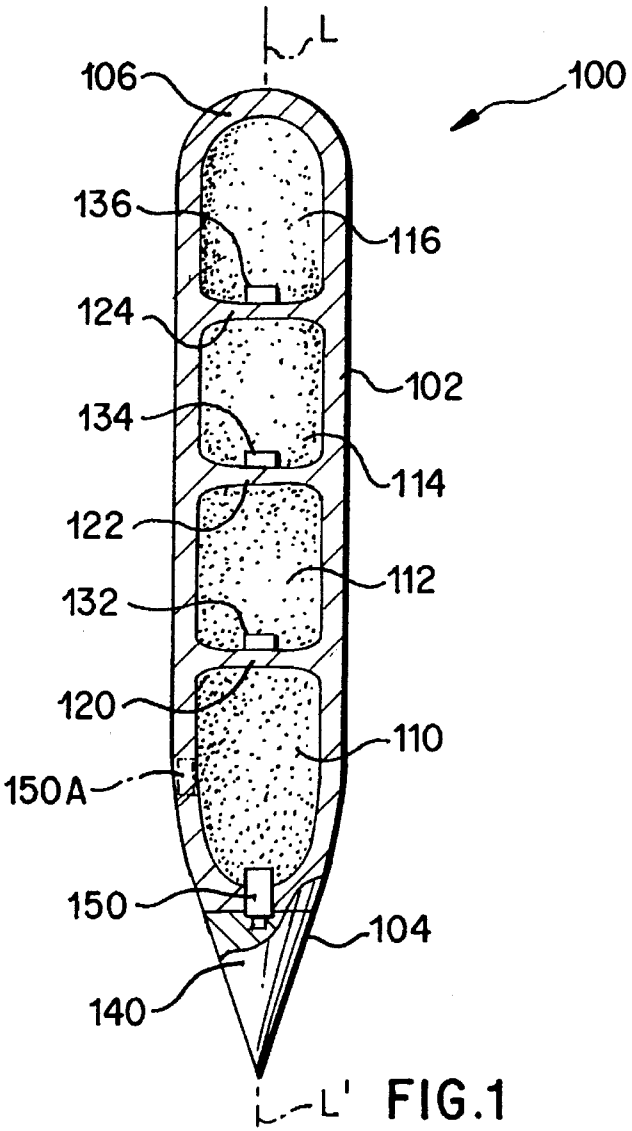
FIG. 1 illustrates, in cross-section, a side view of the multiple warhead weapon according to the present invention.

Referring now to FIG. 1 of the drawing, one embodiment of the weapon or projectile 100 of the present invention is seen to include a casing 102 having a forward end 104, a rearward end 106, and a longitudinal axis LL' defined therebetween. A multiplicity of warheads 110, 112, 114 and 116 is shown to be contained within the casing 102, with the warheads being separated by bulkheads or partitions 120, 122, and 124 secured to the interior of the side walls of the casing between each pair of adjacent warheads. Detonators 132, 134, 136 are positioned in proximity with the warheads 112, 114, 116, respectively. A nose cone 140 is secured to the forward end 104 of the weapon casing, and a fuzing mechanism 150 is provided between the rearward end of the nose cone and the forward end of the warhead 110.

The bulkheads 120, 122, 124 of the weapon 100 are positioned between the warheads and attached to the casing interior walls, and are secured to the casing in such a manner as to withstand a blast larger than the walls of the casing adjacent the warhead, such that when the warhead is detonated, the casing wall around the detonated warhead fails and not the next-forward bulkhead.

A detachable nose cone 140, located at the forward end of the casing, permits access to a fuzing mechanism 150, which may be mechanical or electrical. The fuzing mechanism is preferably connected to each of the detonators 132, 134, 136, for example by a common rod, wire, or wiring bus. The location of the fuzing mechanism forwardly of the warheads is an important aspect of the present invention, in that it prevents a phenomenon known as "slapdown". Slapdown occurs when the trailing end and the nose of a projectile follow trajectories which are not the same. Slapdown involves large deformations and stresses that take place as the trailing end of the projectile realigns itself with the nose.

FIG. 1 also shows an alternate location for the fuze 150. Here the fuze is identified with the numeral 150A, and it is shown housed in the side wall of the projectile casing. This location would allow access to the fuze in the event that a forwardly mounted guidance sensor is required to be installed in the projectile. Such a location would particularly be desirable where analysis showed that mounting the fuze in the sidewall is structurally preferable.

Operation of the fuzing mechanism involves sending a detonation signal to the rearmost detonator first, then to the next forward detonator, then to the next forward detonator, ad seriatim, until the forwardmost detonator is reached. Thus, in the embodiment shown in FIG. 1, a detonation signal is sent first to detonator 136, then a detonation signal is sent to the detonator 134, then a detonation signal is sent to the detonator 132, and finally a detonation signal is sent to the detonator 150.

It is to be noted that the warheads 110, 112, 114, 116 are mounted in tandem with one another within the outer casing 106 of the weapon throughout the entire flight of the weapon until it reaches the target destination. At that time, the warheads are detonated, sequentially and one at a time, from the rearmost warhead forwardly to the forwardmost warhead.

Figure 2:
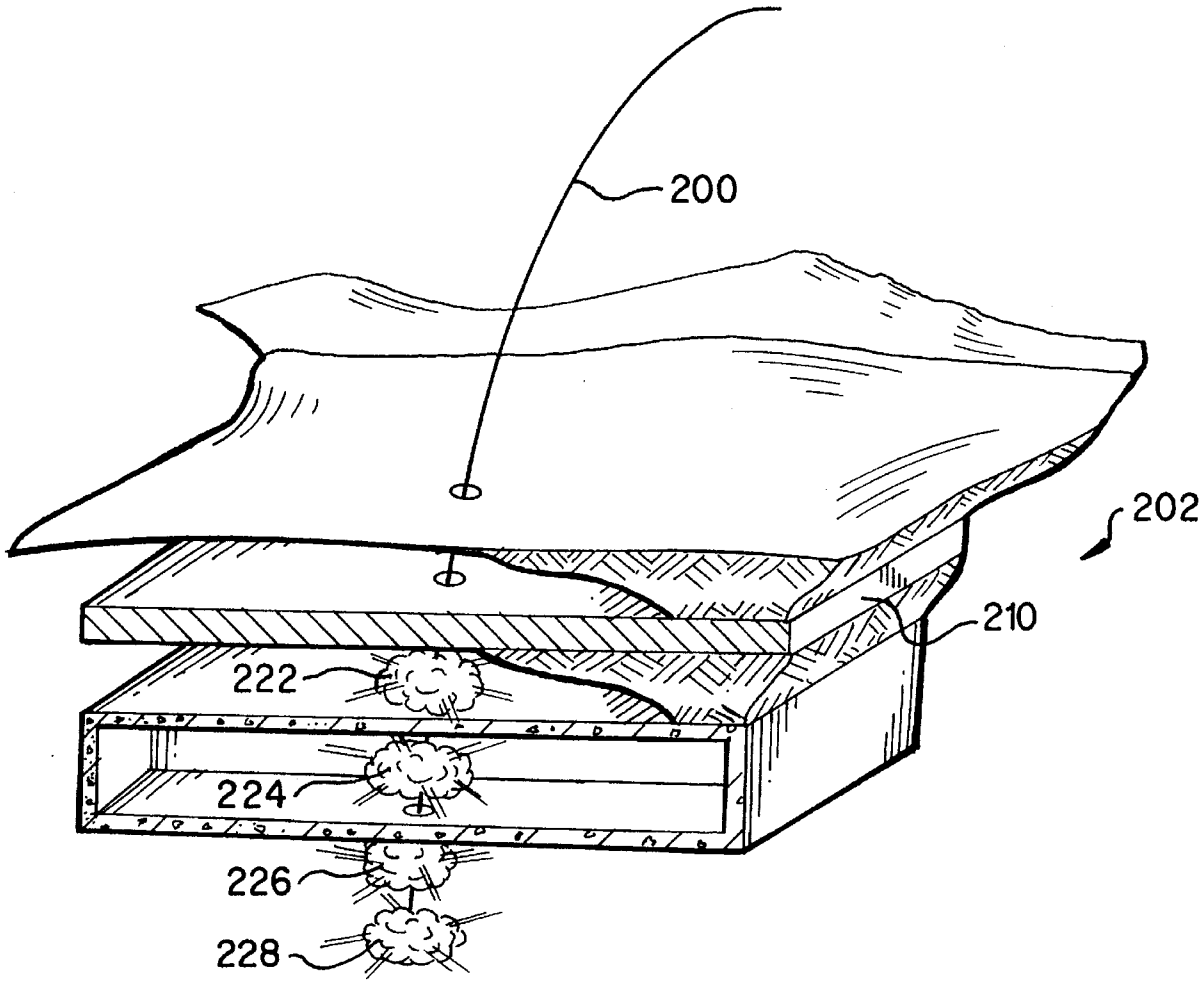
FIG. 2 shows the penetration trajectory of a weapon of the present invention through a generic deeply buried and hardened target.

Referring next to FIG. 2, the penetration trajectory 200 of the weapon 100 is shown after entering the earth and traveling toward a deeply buried and hardened target 202 comprising metal or concrete overburden 210 covering a multi-layer bunker having horizontal floors. The figure shows four explosions 222, 224, 226, 228 which have taken place at four different vertical locations corresponding to time delays designed into the pattern of warhead explosions. Explosion 222 corresponds to warhead 116 of FIG. 1, explosion 224 corresponds to warhead 114, explosion 226 corresponds to warhead 116 and explosion 228 corresponds to warhead 110.

The vertical explosion pattern shown in FIG. 2 is significant in that it provides the penetrating weapon 100 with a greater probability of target destruction than a penetrating weapon which provides a single explosion of higher yield.

In addition, the rearward-to-forward detonation pattern of the warheads is significant insofar as it enables greater penetration depth of a weapon than is possible by any known weapon providing a forward-to-rearward (i.e., rearwardly directed) pattern of detonations. This advantage is due to the fact that as each rearward warhead explodes, it acts as a hammer or pile driver, impacting on the bulkhead forwardly of the detonated warhead to impel the remaining portion of the weapon forwardly in the direction of the trajectory.

Figure 3:
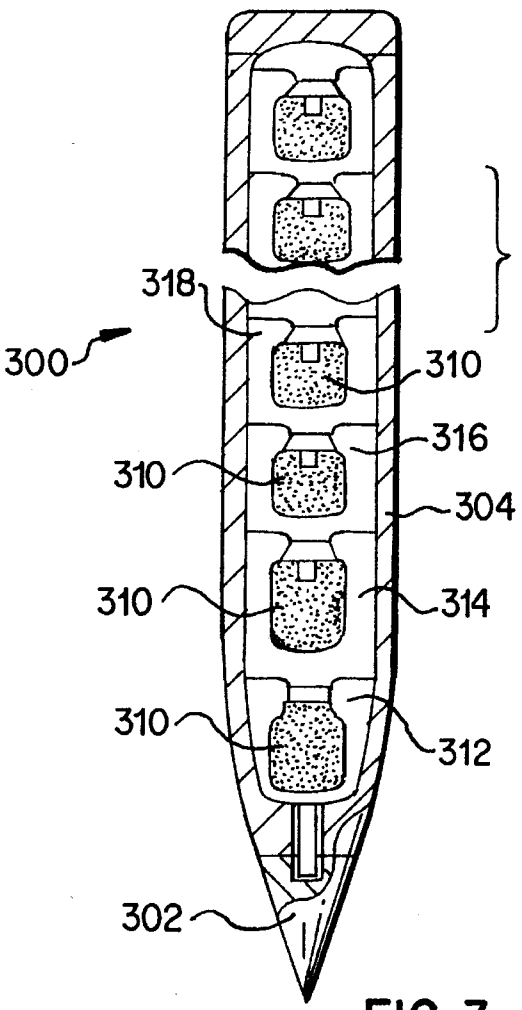
FIG. 3 shows, in cross-section, a side view of a second embodiment of the multiple warhead projectile-type weapon according to the present invention.

FIG. 3 illustrates a second embodiment 300 of the weapon of the present invention. A nose cone 302 is attached, via threading or bonding, to a weapon body 304 which forms the casing of the weapon. A plurality of warheads 310 are positioned at spaced locations along the longitudinal axis of the casing, and are retained in such locations by warhead housings 312, 314, 316 which are threaded or bonded to the interior walls of the weapon casing so that they remain fixed in position throughout the flight of the weapon.

At the top or rearward portion of each warhead housing there is a combined detonator and fuzing mechanism device DF which is incorporated in a bulkhead or partition separating adjacent warheads. The combined detonator and fuzing mechanism also effectively acts as a plug or cap to keep the explosive material of the warhead contained within the housing to which it is secured. It is to be noted that the first warhead housing is secured within the forwardmost region of the casing, and then each next rearwardly positioned warhead housing is piggybacked onto the just preceding housing.

Obviously, many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. A multiple warhead projectile, comprising:

at least two warheads, each warhead having a detonator, a solid, frangible partition disposed between adjacent ones of said warheads, and a fuze for said warheads located inside a forward region of said projectile, said fuze being coupled with each detonator in such a manner that the rearmost warhead explodes first, and then the next forward warhead explodes, when said projectile reaches a predetermined target, whereby, until said target is reached, said projectile remains intact.

2. A projectile weapon for the destruction of a deeply buried and hardened target, comprising:

a housing defining a longitudinal axis, and having a forward end and a rearward end, and frangible partition means separating said housing into chambers, a warhead and detonator disposed in each of said chambers along said axis, a fuze coupled with each detonator for sequentially detonating said warheads when said projectile reaches said target such that each rearmost warhead is detonated before the successively warhead is detonated, whereby said sequential forward detonation of warheads increases the probability of destruction of said target, said partition means defining means for protecting the sequentially next forward warhead from being detonated when the rearmost warhead detonates, the explosion of each warhead imparting an impulse force on the partition means in the direction of travel of said projectile thereby acting to drive said projectile to a further penetration depth at said target.

3. The multiple warhead projectile of claim 1, wherein said multiple warheads number at least three and said fuze further causes sequential detonation of said warheads sequentially forward, one after another.

4. The multiple warhead projectile of claim 1, and further including a casing for containing said warheads until said projectile reaches its target, each said partition being attached to interior walls of said casing adjacent, and defining a chamber about, each warhead.

5. The multiple warhead projectile of claim 1, wherein the interior walls of said casing proximal said partition are reinforced so that, upon detonation of each warhead, the casing interior wall associated with that warhead's chamber will fail before the next forward partition fails.

6. A projectile weapon for the destruction of a deeply buried and hardened target, comprising:

a casing having a forward end and a rearward end, and defining a longitudinal axis, a plurality of warheads disposed in said casing along said axis, means for sequentially detonating said warheads from the rearmost warhead when said projectile reaches said target forwardly including a fuze located at the forward end of said casing and a detonator mechanism operatively coupled between warhead and said fuze, whereby said sequential detonation of warheads increases the probability of destruction of said target, said casing including solid partitions disposed between adjacent warheads and secured to interior wall regions of the casing so that each sequential warhead detonation is contained within a chamber associated with the detonated warhead and is isolated from the next forward, undetonated, warhead in the next forward chamber.

7. The projectile of claim 6, wherein said partition means are configured so as to force failure of the chamber sidewalls before failure of the next forward partition means upon detonation of each warhead.

8. The projectile of claim 6, wherein said partition means are made of a material possessing structural properties which will force failure of the chamber sidewalls before failure of the next forward partition means upon detonation of each warhead.

9. The projectile of claim 6, wherein the interior walls of said casing proximal said partition means are reinforced so that, upon detonation of each warhead, the casing interior wall will fail before the next forward partition means fails.

10. The projectile of claim 6, wherein, when a warhead detonates, the explosion imparts an impulse force on the partition means in the direction of travel of said projectile thereby acting to drive said projectile to a further penetration depth at said target.

* * * * *